US005845526A

United States Patent [19]

Kadoma et al.

[11] Patent Number: 5,845,526

[45] Date of Patent: Dec. 8, 1998

[54] METHOD FOR PRODUCING PIPE HAVING POLYGON-SHAPED CLOSED CROSS-SECTION AND DEVICE THEREFOR

[75] Inventors: Yoshiaki Kadoma; Iwao Nihashi, both of Okazaki; Hideo Ogawa, Isukui-gun; Hiroyuki Amino, Fujinomiya; Youji Suzuki, Shizuoka, all of Japan

[73] Assignees: Toyota Jidosha Kabushiki Kaisha, Toyota; Amino Corporation, Fujinomiya, both of Japan

[21] Appl. No.: 831,477

[22] Filed: Mar. 31, 1997

[30] Foreign Application Priority Data

Apr. 5, 1996 [JP] Japan ..... 8-083821

[51] Int. Cl.[6] ..... B21D 39/02; B21D 51/28

[52] U.S. Cl. ..... 72/51; 72/52

[58] Field of Search ..... 72/51, 52, 176, 72/178, 179, 180, 181, 182, 379.2

[56] References Cited

U.S. PATENT DOCUMENTS

| | | | |
|---|---|---|---|
| 1,708,872 | 11/1929 | Coates . | |
| 1,785,025 | 12/1930 | Felsenthal | 72/379.2 |
| 2,942,643 | 10/1960 | Pucci et al. . | |
| 3,119,432 | 1/1964 | Rogers | 72/176 |
| 5,104,026 | 4/1992 | Sturrus et al. | 72/52 |

FOREIGN PATENT DOCUMENTS

| | | | |
|---|---|---|---|
| A2-0 384 287 | 8/1990 | European Pat. Off. . | |
| B2-57-52128 | 11/1982 | Japan . | |
| 62-54523-A | 3/1987 | Japan | 72/51 |
| B2-2-61333 | 12/1990 | Japan . | |
| A-3-221213 | 9/1991 | Japan . | |
| Y2-5-27208 | 7/1993 | Japan . | |
| 328890 | 5/1930 | United Kingdom . | |

*Primary Examiner*—Joseph J. Hail, III
*Assistant Examiner*—Rodney Butler
*Attorney, Agent, or Firm*—Oliff & Berridge, PLC

[57] ABSTRACT

A method for continuously producing pipes, each having a polygon-shaped closed cross-section taken perpendicularly to the feeding direction of a strip of metal, which are free from brittleness caused by metal fatigue, and have good precision. A feed-bending method of successively feeding a strip of metal (work) W between a main die body, mandrel, punch and correction punches by predetermined feed lengths, and pressing the work W with these members synchroously with feeding is performed. The work W is gradually bent along designed ridgelines L1 through L2 extending in the feeding direction and defining ridgelines L5 through L8 of a product pipe W1, from the ridgelines L1 and L2 close to widthwise ends e1 and e2 to the ridgelines L3 and L4 in the widthwise center thereof in the course between the vicinity of an inlet and the vicinity of a middle of a device, and then, a resulting rough pipe W0 is corrected from the inside and outside thereof in the vicinity of an outlet of the device.

12 Claims, 9 Drawing Sheets

METHOD FOR PRODUCING PIPE HAVING POLYGON-SHAPED CLOSED CROSS-SECTION AND DEVICE THEREFOR

BACKGROUND OF THE INVENTION

1. Field of the Invention

The present invention relates to a method for continuously producing pipes, each having a polygon-shaped closed cross-section taken perpendicularly to the feeding direction of a strip of metal, by using a feed-bending method, and a device therefor. The pies obtained by this method and device are applicable to reinforcing members for bumpers or the like.

2. Description of Related Art

The feed-bending method is the method using a punch and die, for example, as first and second die members, and includes the steps of feeding a strip of metal between the punch and die by predetermined feed lengths, and pressing the strip with the punch and die synchronously with feeding. With this method, since the strip is pressed while being fed by predetermined feed lengths, a small-sized punch or the like is available. The feed-bending method thus arranged enables production of various kinds of products in small quantities at low costs, which has not been effected with a general pressing method of forming a strip of a predetermined length with a large-sized press, and a roll-forming method of forming a strip with a large number of rolls which are arranged sequentially with predetermined angles.

Examples of the conventional method or device using the feed-bending method described above include a continuous forming method of long-sized channel materials with a press die (Japanese Patent publication No. sho 57-52128), a feed-bending forming method of circular pipes with an edge bending system (Japanese Patent publication No. Hei 2-61333), a continuous forming device of pipes of various lengths (Japanese Utility Model publication No. Hei 5-27208) and a forming device for plate like long size body (Japanese Patent application laid-open No. Hei 3-221213).

The conventional methods or devices described above, however, neither disclose nor suggest continuous forming methods or devices of pipes, each having a polygon-shaped closed section taken in a direction perpendicular to the feeding direction of a strip.

More specifically, in the methods of Japanese Patent publication No. Hei 2-61333 and Japanese Utility Model publication No. Hei 5-27208, widthwise edges of strips are bent inwardly in its width direction with a curvature approximately identical to that of desired circular pipes between an inlet defined by a punch and die and an outlet defined thereby (edge bending), which causes resulting pressed products to have closed circular cross-sections taken perpendicularly to the feeding direction. If pipes, each having a polygon-shaped closed cross-section, are intended to produce with the edge bending system described above, designed ridgelines of the strip, which define ridgelines of resulting pipes, would extend in a direction crossing the feeding direction, and shift in parallel therewith every pressing operation. This results in that the strip would be bent and crushed repeatedly along the designed ridgelines, and resulting pipes would become brittle due to metal fatigue.

On the other hand, in the method and device of Japanese Patent publication No. sho 57-52128 and Japanese Patent application laid-open No. Hei 3-221213, strips are gradually bent through 90 degrees or more, and designed ridgelines extend in the feeding direction, so resulting pressed products have angular cross-sections taken perpendicularly to the feeding direction and do not become brittle due to metal fatigue. With these method and device, however, pressed products, each having a closed cross-section, cannot be obtained, because upon bending, both side edges thereof extend generally in parallel with each other or in directions crossing at approximately right angles in a separated state.

In the device of Japanese Patent application laid-open No. Hei 3-221213, a strip is initially bent along a designed ridgeline of the widthwise center thereof, and then bent along the designed ridgelines near the widthwise ends by copying them with a copying model. With this device, however, desired interior angles inside the ridgelines of resulting pressed products are difficult to obtain, and accordingly, precise polygon-shaped cross-sections are difficult to obtain.

SUMMARY OF THE INVENTION

It is an object of the present invention to provide a method of continuously producing pipes, each having a polygon-shaped closed cross-section taken perpendicularly to the feeding direction of a strip, which are free from brittleness caused by metal fatigue, and have good precision, and a device for effecting such a method.

A first aspect of the method of producing pipes, each having a polygon-shaped closed cross-section, in accordance with the present invention, is a feed-bending method including the steps of successively feeding a strip of metal between a first die and a second die by predetermined feed lengths, and pressing the strip with the first die and second die synchronously with feeding, thereby continuously forming pipes, each having a polygon-shaped closed cross-section taken perpendicularly to the feeding direction. The method includes the steps of gradually bending a strip of metal along designed ridgelines defining ridgelines of pipes, each having a polygon-shaped closed cross-section, which extend in the feeding direction, from those close to widthwise ends of the strip towards those near a widthwise center thereof in the course between the vicinity of an inlet defined by the first and second dies and the vicinity of a middle thereof, thereby forming a rough pipe which is connected to the strip and has interior angles inside the designed ridgelines, each of which is approximately identical to that inside a corresponding desired ridgeline, and of which widthwise ends are substantially flush with each other and abuttable each other, and correcting the rough pipe form both the inside and outside thereof in the vicinity of the outlet defined by the first and second dies, thus obtaining a product pipe connected to the rough pipe.

With the method in accordance with the present invention, while the strip (work) is fed from the vicinity of the inlet defined by the first and second dies to the vicinity of the middle thereof, the rough pipe connected to the work is initially obtained. In this step, the work is merely bent gradually along designed ridgelines defining desired ridgelines of a product pipe, because they extend in the feeding direction, which does not cause brittleness due to metal fatigue.

Where, as described above, the work is bent along designed ridgelines which extend in the feeding direction, the work which has been bent only along the designed ridgelines close to the widthwise ends may deform in a twisting direction in the surfaces corresponding to segments extending in parallel with the pressing direction in the cross-section taken perpendicularly to the feeding direction. This results in, if the work still extends linearly in a longitudinal direction, tensile strain being generated in these surfaces thereof on the side of ends in relation to the central line which extends perpendicularly to the pressing direction, while compressive strain being generated in these surfaces on the side of a central portion in relation to the above-described central line. Accordingly, camber may be generated with a longitudinal central portion as the center of curvature. With the method in accordance with the present invention, the work is bent gradually along the designed ridgelines from those close to the widthwise ends towards those near the widthwise center. Therefore, the above-described surfaces of the work have a short length in a pressing direction, thus mininizing the above camber therein. With this arrangement, however, camber of the work is still inevitable, and may remain in a resulting pipe as a pressed product. Accordingly, if pipes having no or reduced camber are desired, camber must be restrained. To this end, the step of producing a rough pipe may be performed with an inclination or curvature which causes oppositely curved camber given thereto (first means). With this first means, the above-describe(ed surfaces corresponding to segments of the cross-section taken perpendicularly to the feeding direction, which are parallel with the pressing direction, tensile strain which would be generated on the side of ends in relation to the central line extending perpendicularly to the pressing direction can be restrained or eliminated, and compressive strain which would be generated on the side of the central portion in relation to the above-described central line can be also restrained or eliminated. With this first means, a desired curvature can be also given to the pipe.

In the work which has been bent along designed ridgelines next to the initially bent designed ridgelines, tensile strain has been eliminated from the widthwise ends of the work so that wrinkles may be generated therein. Even if a rough pipe is produced with an inclination or curvature given to the work with the first means, these wrinkles would be generated, and remain in a resulting pipe as a pressed product. These wrinkles are normally less-desirable so as to be needed to restrain. Furthermore, when the rough pipe is produced with a high inclination or curvature given to the work, a great springback occurs in the work in its feeding direction. This may cause the work to be caught between the first die and/or second die to block feeding of the work. To overcome this problem, the rough pipe may be produced while forming bead-like projections on a central surface of the work in a direction perpendicular to the feeding direction thereof, and then crushing the projections formed (second means). With this second means, elongation can be given to the central surface of the work to restrain tensile strain near the widthwise ends, thereby restraining or eliminating wrinkles thereabout, and to restrain springback in the work, thereby preventing the work from being caught by the first die and/or second die. Alternatively, as a third means, the vicinity of the widthwise ends may be pressed to crush the wrinkles therein.

Thus, a resulting rough pipe has interior angles inside designed ridgelines, which are generally identical to those inside corresponding ridgelines of a desired pipe. And the widthwise ends thereof extend flush with each other and are abuttable each other. The widthwise ends of the resulting rough pipe, however, may be separated due to a residual stress, because they have been elongated and shrinked by repeatedly bending operations.

To overcome this problem, the rough pipe is corrected from the inside and outside thereof in the vicinity of the outlet defined by the first and second dies. It is preferable that the rough pipe is initially bent greatly such that the distance between the widthwise ends is smaller than that of a desired pipe, and then, this bending force is released. This results in the widthwise ends of the rough pipe abutting each other, and the wrinkles therein beind crushed. Thus, pipes, each having a polygon-shaped closed cross-section taken perpendicular to the feeding direction, can be obtained continously. By moving the first and second dies located on the widthwise left and right of the device at timings with a predetermined time lag, the widthwise ends of the rough pipe can be superimposed on each other.

Accordingly, with the method in accordance with the present invention, pipes, each having a polygon-shaped closed cross section taken perpendicular to the feeding direction, can be produced continously. The resulting pipes are free from brittleness caused by metal fatige, and have good precision. And these operational effects can be effected with the die in accordance with the present invention.

Other objects, features, and characteristics of the present invention will become apparent upon considerationof the following description and the appended claims with reference to the accompanying drawings, all of which form a part of this specification.

DETAILED DESCRIPTION OF THE PRESENTLY PREFERRED EXEMPLARY EMBODIMENTS

Hereinafter, an embodiment of the present invention will be explained with reference to the accompanying drawings.

Figure 1:
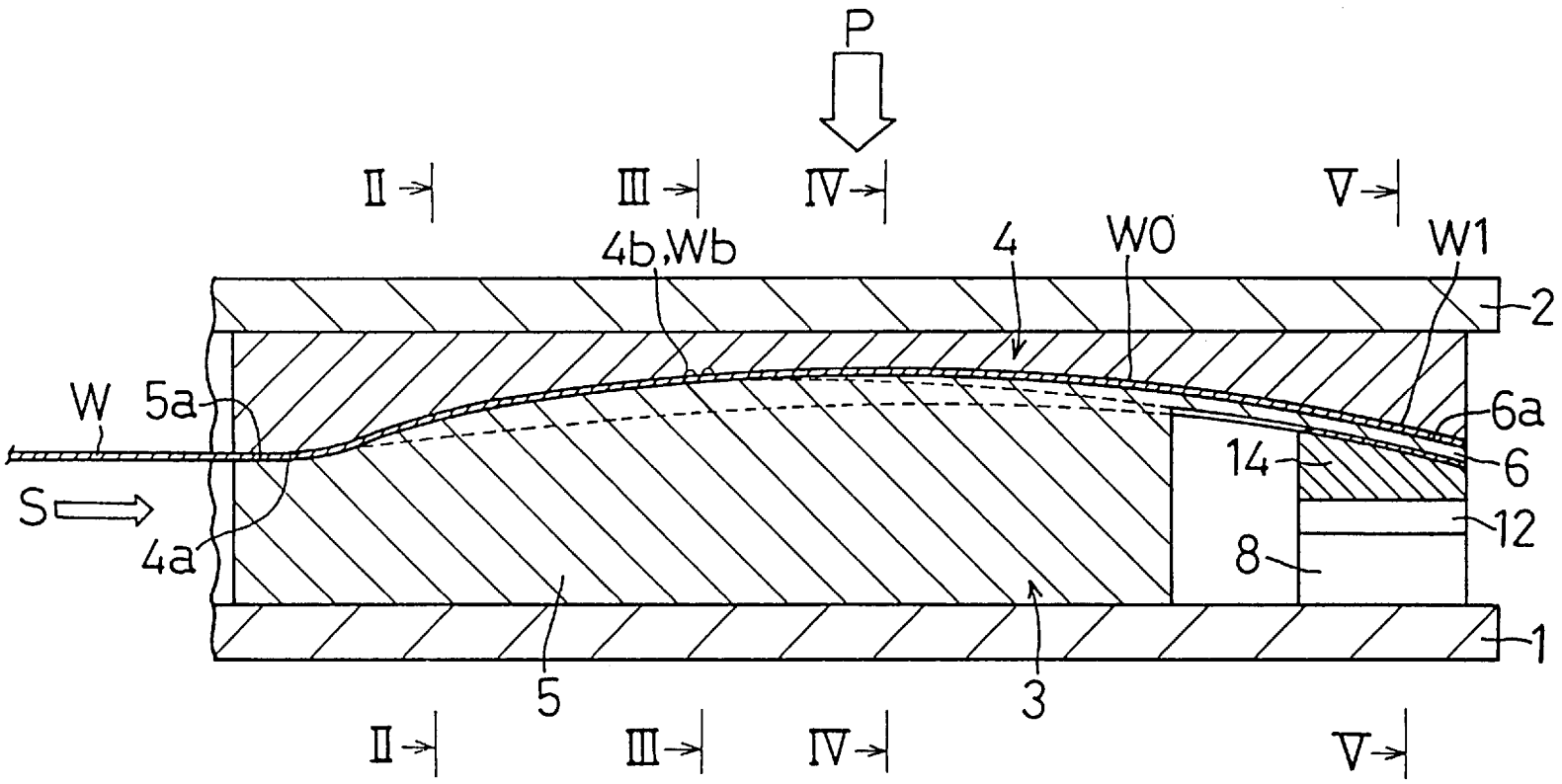
FIG. 1 is a schematic longitudinal sectional view of a forming device used in an embodiment of a method in accordance with the present invention.

FIGS. 1 through 5 illustrate a forming device used in the present embodiment. As shown in FIG. 1, a movable table 2 is positioned over a stationary table 1. The movable table 2 includes a press ram (not shown) which is movable in the pressing direction P. A die 3 as a first die is secured to the stationary table 1 while a punch 4 as one part of a second die is secured to the movable table 2. A feeding means (not shown) adapted to feed a strip (work) W in a horizontal feeding direction S is provided on the left side of the forming device. The die 3 includes a main body 5 extending from an inlet of the forming device, which corresponds to an outlet of the feeding means, to the point slightly right of the middle of the die 3, and a mandrel 6 projecting from an upper end of a right side surface of the main body 5 and extending to an outlet of the forming device.

Figure 2:
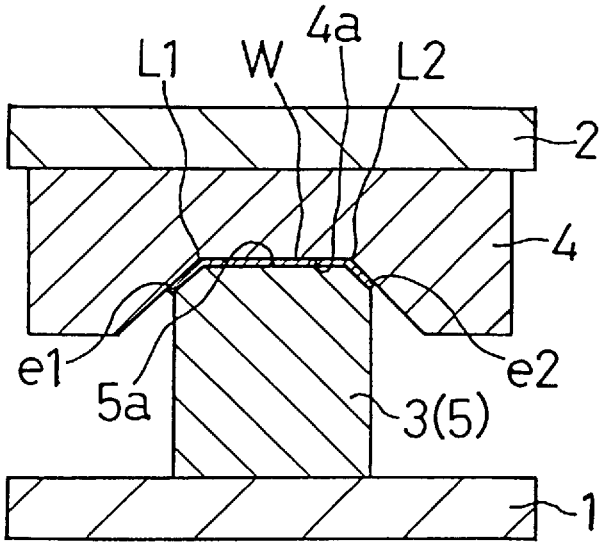
FIG. 2 is a cross-sectional view of the forming device taken along the line II—II of FIG. 1.
Figure 3:
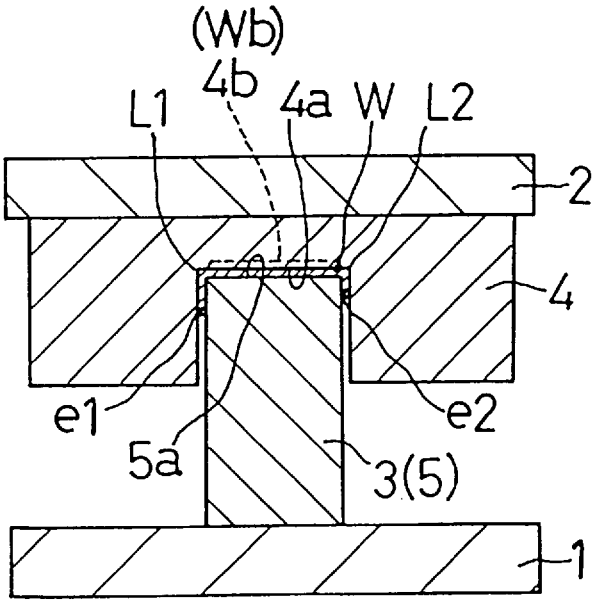
FIG. 3 is a cross-sectional view of the forming device taken along the line III—III of FIG. 1.
Figure 4:
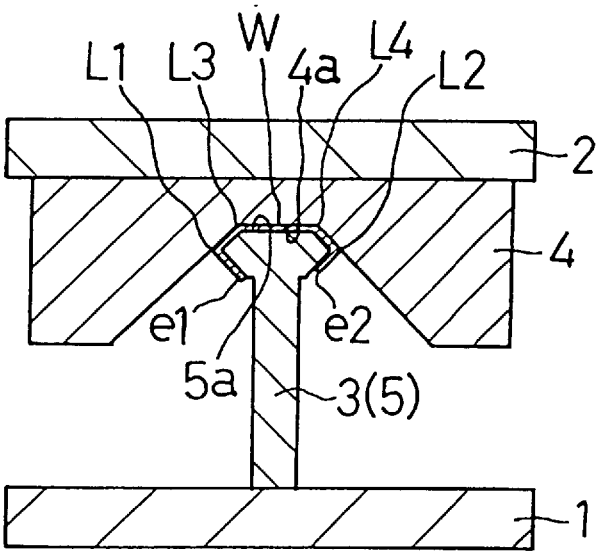
FIG. 4 is a cross-sectional view of the forming device taken along the line IV—IV of FIG. 1.
Figure 5:
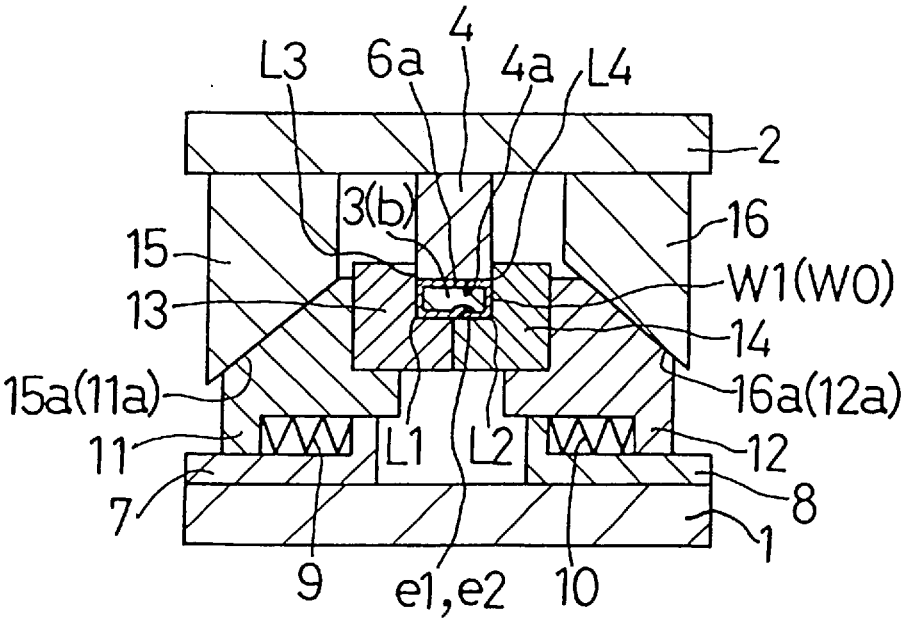
FIG. 5 is a cross-sectional view of the forming device taken along the line V—V of FIG. 1.
Figure 7A:
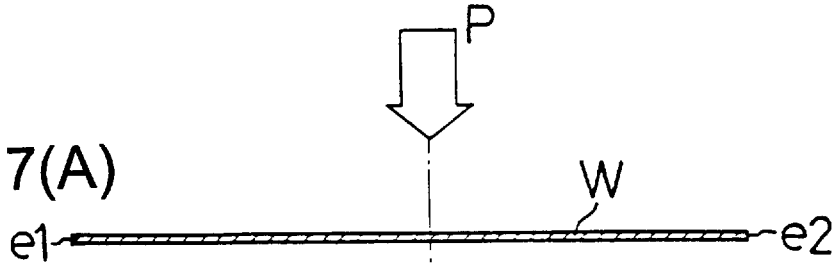
FIG. 7(A) is a cross-sectional view taken in the direction A of FIG. 6.
Figure 7B:
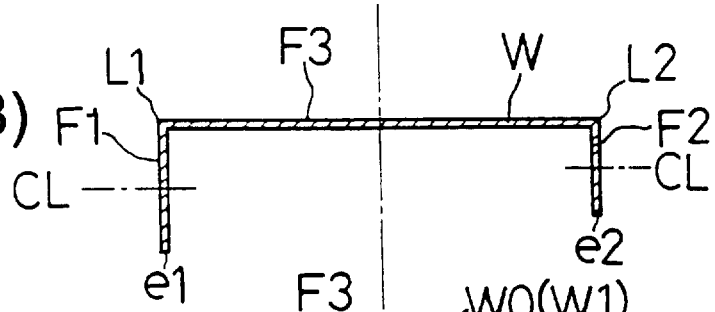
FIG. 7(B) is a cross-sectional view taken in the direction B of FIG. 6.
Figure 7C:
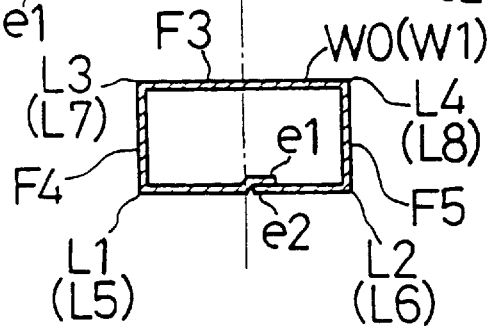
FIG. 7(C) is a cross-sectional view taken in the direction C of FIG. 6.

An upper part of an outer surface 5*a* of the main body 5 in the central section defined by the pressing direction P and feeding direction S is formed flat near the inlet of the forming device, and then curves upwardly. The upper part of the outer surface 5*a* of the main body 5 in the section perpendicular to the feeding direction S is also formed flat near the inlet of the forming device. And, as shown in FIGS. 2 and 3, the outer surface 5*a* of the main body 5 is gradually bent through 90 degrees along lines adapted to bend the work W along designed ridgelines L1 and L2. Next, as shown in FIG. 4, the outer surface 5*a* of the main body 5 is gradually bent along lines adapted to bend the work W along designed ridgelines L3 and L4. As shown in FIGS. 7(A), 7(B) and 7(C), the designed ridgelines L1 and L2 are located near widthwise ends e1 and e2 of the work W while the designed ridgelines L3 and L4 are located next to the designed ridgelines L1 and L2, namely near a widthwise center of the work W. These designed ridgelines L1, L2, L3 and L4 extend in the feeding direction S. As shown in FIGS. 2 to 4, the width of the lower part of the main body 5 decreases with the distance between ends of the outer surface 5*a*. The mandrel 6 has an outer surface 6*a* connected to the outer surface 5*a* of the main body 5, and, as shown in FIG. 5, is gradually bent through 90 degrees along lines adapted to bend the work W along the designed ridgelines L3 and L4.

As shown in FIG. 1, which illustrates a central section defined by the pressing direction P and feeding direction S, an under surface 4*a* of the punch 4 is formed flat near the inlet of the forming device, and then curves upwardly. As shown in FIG. 3, two bead-like grooves 4*b* are formed in an upwardly curving part of the under surface 4*a* in a direction perpendicular to the feeding direction S. In the cross-section of the punch 4, which is perpendicular to the feeding direction S, the under surface 4*a* thereof is formed flat near the inlet of the forming device. As shown in FIGS. 2 and 3, the under surface 4*a* of the punch 4 is gradually bent through 90 degrees along lines adapted to bend the work W along the designed ridgelines L1 and L2. Next, as shown in FIG. 4, the under surface 4*a* of the punch 4 is gradually bent through 90 degrees along lines adapted to bend the work W along designed ridgelines L3 and L4. As shown in FIG. 5, the width of the punch 4 is reduced to about the sum of the width of the mandrel 6 and double of the thickness of the work W.

Near the outlet of the forming device, a pair of slide tables 7 and 8 are secured to left and right of the stationary table 1. Sliders 11 and 12 are slidably provided on the slide tables 7 and 8. The sliders 11 and 12 are biased in directions away from each other with pushing springs 9 and 10. Correction punches 13 and 14 adapted to correct a rough pipe WO with the mandrel 6 and the punch 4 are secured to the sliders 11 and 12. These correction punches 13 and 14 along with the punch 4 define a second die. Slide cams 15 and 16 are secured to the movable table 2. The slide cams 15 and 16 have inclination surfaces 15*a* and 16*a*, respectively. These inclination surfaces 15*a* and 16*a* face each other and conform to inclination surfaces 11*a* and 12*a* of the sliders 11 and 12, respectively. The inclination surfaces 15*a* and 1l*a* are positioned upwardly of the inclination surfaces 16*a* and 12*a*, which enables the correction punches 13 and 14 to move at timings with a predetermined time lag.

Figure 6:
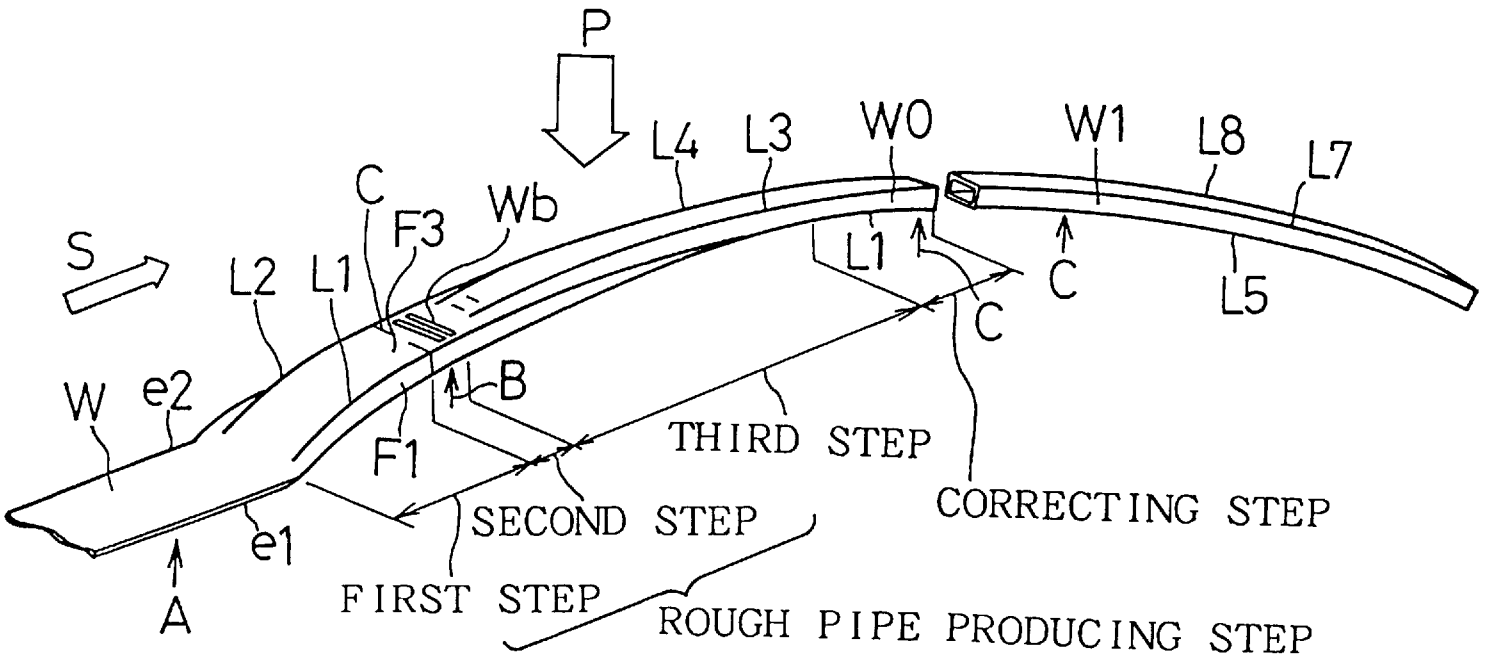
FIG. 6 is a perspective view of a product pipe obtained with the method in accordance with the present invention.

In operation, the work W of metal is successively fed between the main body 5, mandrel 6, punch 4 and correction punches 13 and 14 of the forming device thus arranged by predetermined feed lengths. Synchronously with feeding, the work W is pressed with the main body 5, mandrel 6, punch 4 and correction punches 13 and 14, thus subjecting the work W to a feed-bending method. As a result, as shown in FIG. 6, a pipe W1 is formed continuously.

In the steps of forming a rough pipe, which includes a first to third steps, the rough pipe W0 which is connected to the work W is formed with the main body 5 and punch 4. Since the designed ridgelines L1 through L4 extend in the feeding direction S, the work W is merely bent gradually along the designed ridgelines L1 through L4. This does not cause brittleness of the work due to metal fatigue.

In the first step, as shown in FIGS. 1 and 2, the work W is curved upwardly, which restrains generation of tensile strain in flange surfaces F1, F2 (FIG. 7(B)) of the work W, which correspond to segments parallel to the pressing direction P in the cross-section taken perpendicularly to the feeding direction S, on the side of the ends e1 and e2 in relation to the central line CL extending perpendicularly to the pressing direction P, and also restrains generation of compressive strain in the flange surfaces F1, F2 on the side of the central portion thereof in relation to the central line CL. Furthermore, in the first step, a desired curvature is given to the pipe W1. Since the work W is bent along the designed ridgelines L1 and L2 which are near the ends e1 and e2, the length of the flange surfaces F1 and F2 in the pressing direction P is short, which enables oppositely curving camber of the work W to be minimized. As shown in FIG. 6, in the end of the first step, a cut line C is formed in the work W.

Figure 8:
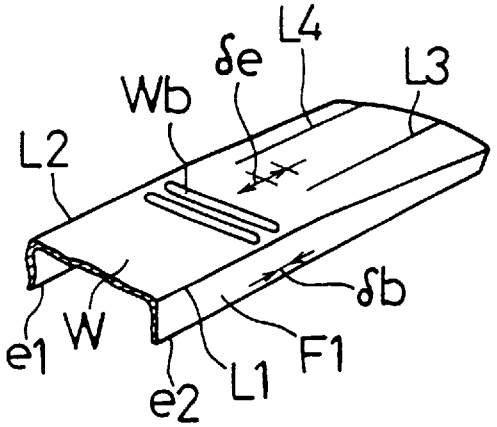
FIG. 8 is a partially enlarged view of FIG. 6.
Figure 11:
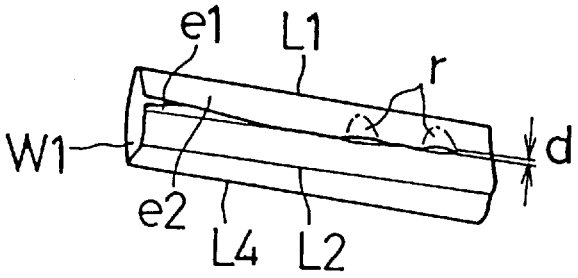
FIG. 11 is a partially enlarged perspective view of FIG. 6.
Figure 13:
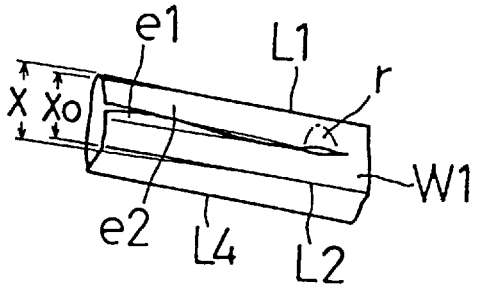
FIG. 13 is a partially enlarged perspective view of FIG. 6.

In the second step, as shown in FIGS. 1 and 3, two bead-like projections Wb are formed on a central web surface F3 of the work W with bead-like grooves 4*b* of the punch 4, and as the forming proceeds, these bead-like projections Wb are crushed. This results in, as shown in FIG. 8, elongation δ e being given on the web surface F3 of the work W to restrain tensile strain δ b near the ends e1 and e2, thus restraining generation of wrinkles r (FIGS. 11 and 13). If generated, the wrinkles r can be crushed by pressing the areas near ends e1 and e2 with a slide core or the like.

Figure 9:
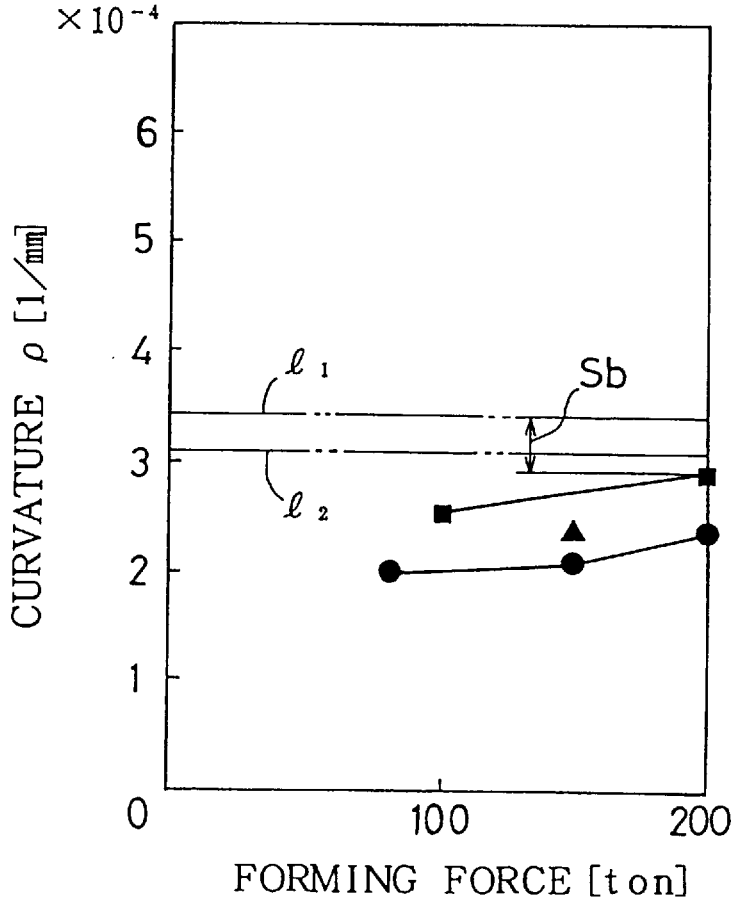
FIG. 9 is a graph showing the relation between the forming force and curvature.

The relation between the forming force (ton) and the curvature ρ (1/mm) showing the curve of the work W in the case of the height of projections Wb being 0 (mm), 1.5 (mm) and 3.0 (mm) was examined. The examination results are shown in the graph of FIG. 9. In the graph, the relation in the case of the height being 0 (mm) is indicated by ●, the relation in the case of the height being 1.5 (mm) is indicated by ■ and the relation in the case of the height being 3.0 (mm) is indicated by ▲. Reference character 11 denotes dimensions of a forming die, and 12 denotes objective dimensions of a product. FIG. 9 shows that by forming the projections Wb on the web surface F3 and thereafter crushing them, springback Sb of the work W can be restrained, and accordingly, the work W can be prevented from being caught between the main body 5, mandrel 6, punch 4 and correction punches 13 and 14.

In a third step, as shown in FIGS. 1 and 4, the work W is bent along the designed ridgelines L3 and L4 to obtain the rough pipe W0. As shown in FIGS. 6 and 7 (C), the interior angles inside the desinged ridgelines L1 through L4 of the rough pipe W0 are 90 degrees, which are approximately identical to those inside the ridgelines L5 through L8 of the product tube W1, and the widthwise ends e1 and e2 are generally flush with each other and abuttable. The ends e1 and e2, however, may separate into an open state due to residual stress, because they have elongated and shrinked by repeatedly bending operations.

Figure 10:
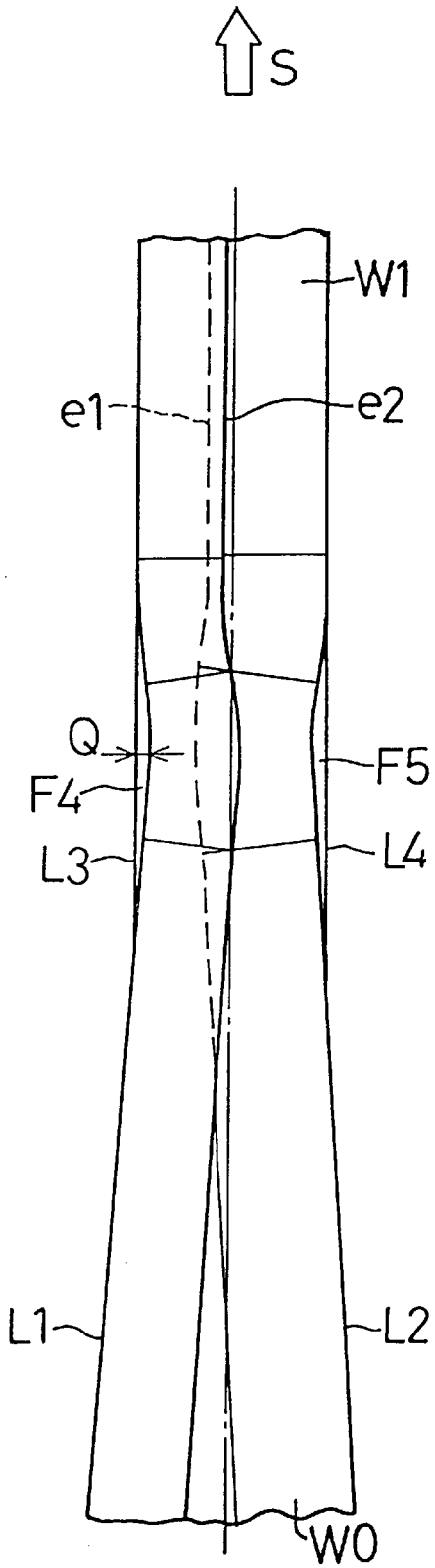
FIG. 10 is a partially enlarged plane view of FIG. 6.

To prevent the above problem, in the following correcting step, the correcting punches 13 and 14 along with the mandrel 6 and the under surface of the punch 4, which faces the mandrel 6, correct the rough pipe W0 from the inside and outside thereof. More specifically, the correcting punches 13 and 14 initially bend the rough pipe W0 greatly such that, as shown in FIGS. 7(C) and 10, the distance between the surfaces F4 and F5 of the rough pipe W0, which extend in parallel with the pressing direction P, becomes smaller than that of corresponding surfaces of a product pipe W1. After that, this bending force is released. As shown in FIG. 5, the correcting punches 13 and 14 are arranged such that when the slide cams 15 and 16 descend, the correcting punch 13 moves prior to the correcting punch 14. Therefore, as shown in FIG. 7(C), the long end e1 initially abuts the mandrel 6, and then the short end e2 abuts the mandrel 6. Thus, open ends e1 and e2 are superimposed on each other, and wrinkles therein are crushed.

Figure 12:
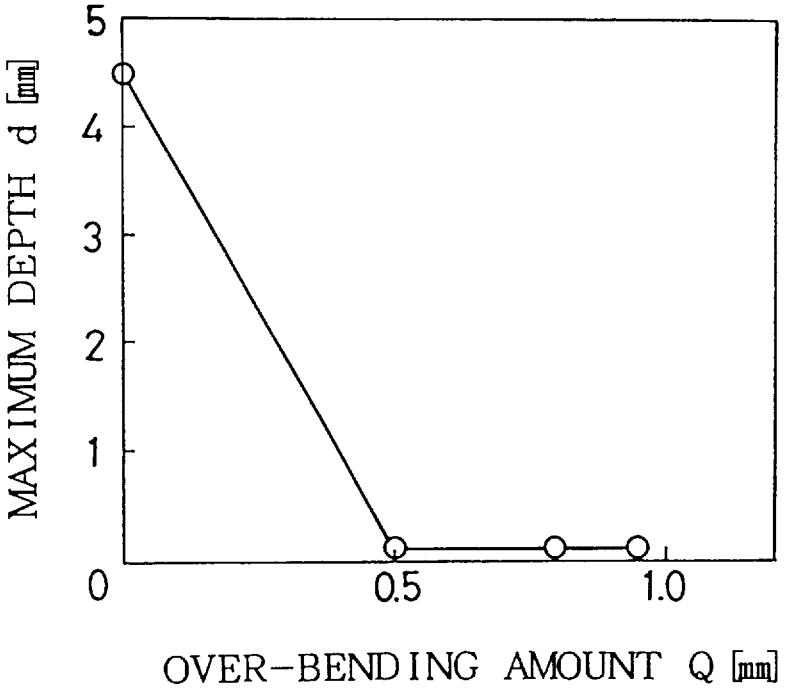
FIG. 12 is a graph showing the relation between the over-bending amount and maximum wrinkle depth.

The relation between the over-bending amount Q (mm), which is the amount by which the correcting punches 13 and 14 bend the rough pipe W0 greatly, as shown in FIG. 10, and the maximum depth d (mm) of the wrinkles r formed near the ends e1 and e2, as shown in FIG. 11, was examined. The examination results are shown in the graph of FIG. 12. As shown, where the rough pipe W0 was first bent greatly by the over-bending amount of about 0.5 mm or more, and then the bending force was released, the generation of wrinkles r was prevented.

Figure 14:
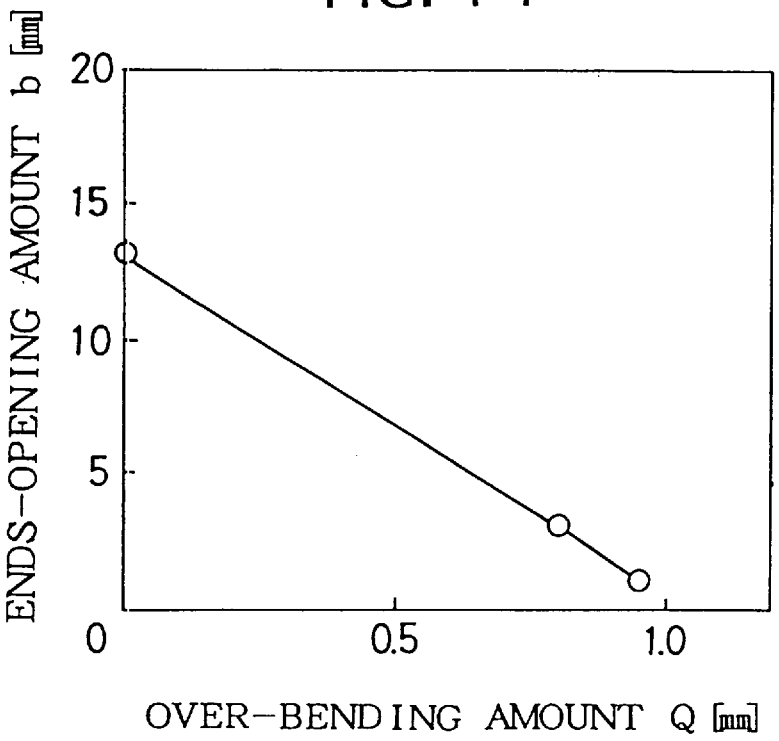
FIG. 14 is a graph showing the relation between the over-bending amount and opening amount of strip ends.

Similarly, the relation between the over-bending amount Q (mm) and the ends-opening amount b (b=X−X0) (mm) shown in FIG. 13, was examined. The examination results are shown in the graph of FIG. 14. As shown, where the rough pipe W0 was first bent greatly by the over-bending amount of about 1.0 mm or more, and then the bending force was released, the ends-opening was prevented.

Thus, as shown in FIG. 6, the pipe W1 having an angular closed cross-section taken perpendicularly to the feeding direction, which is connected to the rough pipe W0, can be obtained continuously. Then, the pipe W1 is cut along the cut line C to obtain a product pipe applicable to a reinforcing member of a bumper, for example.

With the present method, pipes W1, each having a rectangular closed cross-section taken perpendicularly to the feeding direction S of the work W, can be produced continuously. Furthermore, the resulting pipes W1 are free from brittleness caused by metal fatigue, and have good precision. And these operational advantages can be effected with the device of the present embodiment.

While the invention has been described in connection with what are considered presently to be the most practical and preferred embodiments, it is to be understood that the invention is not limited to the disclosed embodiments, but, on the contrary, is intended to cover various modifications and equivalent arrangements included within the spirit and scope of the appended claims.

The entire disclosure of Japanese Patent Application No. 8-83821 filed on Apr. 5, 1996, including specification, claims, drawings and summary is incorporated herein by reference in its entirety.

What is claimed is:

1. A method of continuously producing pipes, each having a polygon-shaped closed cross-section taken perpendicularly to the feeding direction, by a feed-bending method of successively feeding a strip of metal between a first die and a second die by predetermined feed lengths, and pressing the strip with the first die and the second die synchronously with feeding, comprising the steps of:

producing a rough pipe by gradually bending a strip of metal along designed ridgelines which extend in the feeding direction from those close to widthwise ends of the strip towards those near a widthwise center thereof in the course between the vicinity of an inlet defined by the first and second dies and the vicinity of a middle thereof, while said strip is fed in the condition that one of inclinations and curvatures is given thereto to generate oppositely curving camber, and while bead-like projections are initially formed on a central surface of said strip in a direction perpendicular to the feeding direction, and said projections are gradually crushed in accordance with the process of producing said rough pipe, thereby forming said rough pipe which is connected to said strip, each of the designed ridgelines defining an interior angle that is approximately identical to an interior angle defined by a corresponding desired ridgeline, the widthwise ends of the rough pipe being substantially flush with each other and abuttable with each other; and correcting said rough pipe from the inside and outside thereof in the vicinity of an outlet defined by the first and second dies, thereby obtaining a product pipe connected to said rough pipe.

2. A method as claimed in claim 1, wherein in said step of correcting said rough pipe, said rough pipe is initially bent greatly such that the distance between widthwise ends of said rough pipe becomes smaller than that of said desired pipes, and then, a bending force applied to bend said rough pipe is released.

3. A method as claimed in claim 1, wherein in said step of correcting said rough pipe, a first die and a second die which are located on widthwise right and left sides are moved at timings with a predetermined time lag.

4. A method of continuously producing pipes, each having a polygon-shaped closed cross-section taken perpendicularly to the feeding direction, by a feed-bending method of successively feeding a strip of metal between a first die and a second die by predetermined feed lengths, and pressing the strip with the first die and the second die synchronously with feeding, comprising the steps of:

producing a rough pipe by gradually bending a strip of metal along designed ridgelines which extend in the feeding direction from those close to widthwise ends of the strip towards those near a widthwise center thereof in the course between the vicinity of an inlet defined by the first and second dies and the vicinity of a middle thereof, thereby forming said rough pipe which is connected to said strip, each of the designed ridgelines defining an interior angle that is approximately identical to an interior angle defined by a corresponding desired ridgeline, the widthwise ends of the rough pipe being substantially flush with each other and abuttable with each other; and correcting said rough pipe from the inside and outside thereof in the vicinity of an outlet defined by the first and second dies, thereby obtaining a product pipe connected to said rough pipe.

5. A method as claimed in claim 4, wherein in said step of producing said rough pipe, said strip is fed while one of inclinations and curvatures is given thereto to generate oppositely curving camber.

6. A method as claimed in claim 4, wherein in said step of producing said rough pipe, bead-like projections are initially formed on a central surface of said strip in a direction perpendicular to the feeding direction, and as said step of producing said rough pipe proceeds, said projections are gradually crushed.

7. A method as claimed in claim 4, wherein in said step of correcting said rough pipe, said rough pipe is initially bent greatly such that the distance between widthwise ends of said rough pipe becomes smaller than that of said desired pipes, and then, a bending force applied to bend said rough pipe is released.

8. A method as claimed in claim 4, wherein in said step of correcting said rough pipe, a first die and a second die which are located on widthwise right and left sides are moved at timings with a predetermined time lag.

9. A method of continuously producing pipes, each having a polygon-shaped closed cross-section taken perpendicularly to the feeding direction, by a feed-bending method of successively feeding a strip of metal between a first die and a second die by predetermined feed lengths, and pressing the strip with the first die and the second die synchronously with feeding, comprising the steps of:

producing a rough pipe by gradually bending a strip of metal along designed ridgelines which extend in the feeding direction from those close to widthwise ends of the strip towards those near a widthwise center thereof in the course between the vicinity of an inlet defined by the first and second dies and the vicinity of a middle thereof, while said strip is fed in the condition that one of inclinations and curvatures is given thereto to generate oppositely curving camber, thereby forming said rough pipe which is connected to said strip, each of the designed ridgelines defining an interior angle that is approximately identical to an defined by a corresponding desired ridgeline, the widthwise ends of the rough pipe being substantially flush with each other and abuttable with each other; and correcting said rough pipe from the inside and outside thereof in the vicinity of an outlet defined by the first and second dies, while said rough pipe is initially bent greatly such that the distance between widthwise ends of said rough pipe becomes smaller than that of said desired pipes, and then, a bending force applied to bend said rough pipe is released, thereby obtaining a product pipe connected to said rough pipe.

10. A method of continuously producing pipes, each having a polygon-shaped closed cross-section taken perpendicularly to the feeding direction, by a feed-bending method of successively feeding a strip of metal between a first die and a second die by predetermined feed lengths, and pressing the strip with the first die and the second die synchronously with feeding, comprising the steps of:

producing a rough pipe by gradually bending a strip of metal along designed ridgelines which extend in the feeding direction from those close to widthwise ends of the strip towards those near a widthwise center thereof in the course between the vicinity of an inlet defined by the first and second dies and the vicinity of a middle thereof, while said strip is fed in the condition that one of inclinations and curvatures is given thereto to generate oppositely curving camber, thereby forming said rough pipe which is connected to said strip, each of the designed ridgelines defining an interior angle that is approximately identical to an an interior angle defined by a corresponding desired ridgeline, the widthwise ends of the rough pipe being substantially flush with each other and abuttable with each other; and correcting said rough pipe from the inside and outside thereof in the vicinity of an outlet defined by the first and second dies, wherein a first die and a second die which are located on widthwise right and left sides are moved at timings with a predetermined time lag, thereby obtaining a product pipe connected to said rough pipe.

11. A method of continuously producing pipes, each having a polygon-shaped closed cross-section taken perpendicularly to the feeding direction, by a feed-bending method of successively feeding a strip of metal between a first die and a second die by predetermined feed lengths, and pressing the strip with the first die and the second die synchronously with feeding, comprising the steps of:

producing a rough pipe by gradually bending a strip of metal along designed ridgelines which extend in the feeding direction from those close to widthwise ends of the strip towards those near a widthwise center thereof in the course between the vicinity of an inlet defined by the first and second dies and the vicinity of a middle thereof, while said strip is fed in the condition that one of inclinations and curvatures is given thereto to generate oppositely curving camber, and while bead-like projections are initially formed on a central surface of said strip in a direction perpendicular to the feeding direction, and said projections are gradually crushed in accordance with the process of producing said rough pipe, thereby forming said rough pipe which is connected to said strip, each of the designed ridgelines defining an interior angle that is approximately identical to an interior angle defined by a corresponding desired ridgeline, the widthwise ends of the rough pipe being substantially flush with each other and abuttable with each other; and correcting said rough pipe from the inside and outside thereof in the vicinity of an outlet defined by the first and second dies, while said rough pipe is initially bent greatly such that the distance between widthwise ends of said rough pipe becomes smaller than that of said desired pipes, and then, a bending force applied to bend said rough pipe is released, wherein a first die and second die which are located on widthwise right and left sides are moved at timings with a predetermined time lag, thereby obtaining a product pipe connected to said rough pipe.

12. A device for continuously producing pipes, each having a polygon-shaped closed cross-section taken perpendicularly to the feeding direction, by a feed-bending method of successively feeding a strip of metal into said die by predetermined feed lengths, and pressing the strip with said die synchronously with feeding, comprising:

a first die and a second die which are arranged such that a strip of metal is gradually bent along designed ridgelines extending in the feeding direction, from those close to widthwise ends of said strip towards a widthwise center thereof in the course between the vicinity of an inlet defined by said first die and said second die and the vicinity of a middle thereof, thereby forming a rough pipe which is connected to said strip, each of the designed ridgelines defining an interior angle that is approximately identical to an interior angle defined by a corresponding desired ridgeline, the widthwise ends of the rough pipe being substantially flush with each other and abuttable with each other, and such that said rough pipe is corrected from the inside and outside thereof in the vicinity of an outlet defined by said first die and said second die, thereby obtaining a product pipe which is connected to said rough pipe, said first die includes a main body which extends from the vicinity of said inlet to the vicinity of said middle, and a mandrel which is integrally connected to an outer surface of said main body and extends to said outlet, said outer surface of said main body in a central section defined by the pressing direction and the feeding direction is formed horizontal in the vicinity of said inlet, and then curves upwardly, and said second die includes a punch adapted to face said main body and said mandrel of said first die, and a pair of correction punches which are adapted to face said mandrel, and movable widthwise leftwards and rightwards, an outer surface of said punch of said second die in the central section defined by the pressing direction and feeding direction is formed horizontal in the vicinity of said inlet, and then curves upwardly.

* * * * *